US006070791A

United States Patent [19]

Correll

[11] Patent Number: 6,070,791

[45] Date of Patent: Jun. 6, 2000

[54] NON-RADIALLY-SYMMETRICAL, PIZZA-BOX-FITABLE FOOD CUP

[76] Inventor: John D. Correll, 8459 Holly Dr., Canton, Mich. 48187

[21] Appl. No.: 09/264,305

[22] Filed: Mar. 8, 1999

Related U.S. Application Data

[63] Continuation-in-part of application No. 09/002,153, Dec. 31, 1997, Pat. No. 5,881,948.

[51] Int. Cl.[7] ..... B65D 1/40; B65D 5/42

[52] U.S. Cl. ..... 229/120.01; 220/23.83; 229/906

[58] Field of Search ..... 229/120.01, 902, 229/906; 220/23.83, 23.87, 23.88

[56] References Cited

U.S. PATENT DOCUMENTS

| | | | |
|---|---|---|---|
| D. 303,766 | 10/1989 | Delbanco | D9/430 |
| D. 349,050 | 7/1994 | Krupa | D9/425 |
| D. 391,808 | 3/1998 | Voege | D7/629 |
| D. 392,883 | 3/1998 | Ferrin | D9/430 |
| 3,384,260 | 5/1968 | Buffington | 220/23.83 |
| 3,442,435 | 5/1969 | Ludder et al. | 220/23.83 |
| 4,373,636 | 2/1983 | Hoffman | 206/551 |
| 4,854,466 | 8/1989 | Lane, Jr. | 220/23.83 |
| 5,098,013 | 3/1992 | France et al. | 229/115 |
| 5,429,262 | 7/1995 | Sharkey | 220/23.83 |
| 5,743,210 | 4/1998 | Lampe | 220/23.83 |
| 5,881,948 | 3/1999 | Correll | 229/906 |
| 5,950,913 | 9/1999 | Rea et al. | 220/23.88 |

FOREIGN PATENT DOCUMENTS

| | | | |
|---|---|---|---|
| 239472 | 9/1987 | European Pat. Off. | 220/23.83 |
| 1560488 | 2/1980 | United Kingdom | 220/23.83 |

OTHER PUBLICATIONS

Photo 1: A Collection of Prior Art Plastic Food Cups. Photographer J. Correll, Mar. 1999.

Photo 2: A Prior Art Plastic Container. Photographer, J. Correll, Mar. 1999.

*Primary Examiner*—Gary E. Elkins

[57] ABSTRACT

A plastic food cup fitable within a corner space of a loaded pizza box and having a non-radially-symmetrical top edge perimeter having a corner-fitting component and a diagonal connecting component and, in the preferred embodiment, resembling the shape of an isosceles right triangle.

35 Claims, 4 Drawing Sheets

NON-RADIALLY-SYMMETRICAL, PIZZA-BOX-FITABLE FOOD CUP

CROSS-REFERENCES TO RELATED APPLICATIONS

This is a continuation-in-part application of my application Ser. No. 09/002,153, entitled "Expandable Pizza Box," filed Dec. 31, 1997, now U.S. Pat. No. 5,881,948. The invention is shown in FIG. 8 of that patent and discussed in the Conclusion, Ramifications, and Scope section thereof.

FIELD OF THE INVENTION

This invention relates to containers and, in particular, to plastic cup-type containers for carrying small or individual portions of food product such as sauce or dressing.

DESCRIPTION OF THE PRIOR ART

Many delivery/carry-out pizzerias pack a small plastic cup containing a food product, such as sauce, cheese, or spices, inside a pizza box along with the pizza. This cup, often referred to as an "individual portion cup," is placed into a corner space of the box. From a two-dimensional top view, this space is bounded on two sides by adjoining walls of the box and on a third side by an outer edge of the pizza. To illustrate, FIG. 1 shows a schematic two-dimensional top view of a corner section of the tray portion of a pizza box 10 containing a round pizza 12. Box 10 has adjoining walls 14,15 converging at a corner 16. Pizza 12 has an outer edge 18 that is tangential with walls 14,15. From the convergence of edge 18 with walls 14,15, a corner space 20 is created.

It should be noted that the shape of space 20 resembles that of an isosceles right triangle, except with the hypotenuse (edge 18) being curved.

The cup can be filled with food product either in a factory or in the pizzeria. When filled in the factory the cup is typically covered with a thin sheet of removable film adhesively secured to a top edge of the cup. When filled in the pizzeria, it is usually capped with a separate removable and re-attachable plastic lid.

In the prior art there are various shapes of cups, the shape of a cup being defined herein as the two-dimensional shape of the top edge perimeter of the cup. Examples of some prior art cups are shown in Photo 1. Common shapes of individual portion cups include round, oval, rectangular, and rounded-rectangular (i.e., a rectangle in which the perpendicular corners have been converted to round curves). Examples of these four shapes of top edge perimeter are shown in FIGS. 4 through 7, which show round shape 22, oval shape 24, rectangular shape 26, and rounded-rectangular shape 28, respectively.

Also used in the food industry are two-piece containers, consisting of a tray portion and a cover portion hingedly attached to a top edge of the tray portion, for holding a single slice of pie. An example is shown in Photo 2.

The shape of the typical plastic cup used in the pizzeria industry is round. Its main use is for packing a small portion of sauce-type product such butter sauce, pizza sauce, BBQ sauce, or salad dressing. The volume capacities of these cups range from 30 to 100 milliliters (1.0 to 3.5 fluid ounces); their heights range from 2.0 to 4.5 centimeters (0.75 to 1.75 inches); and their top edge diameters range from 5.0 to 7.6 centimeters (2.0 to 3.0 inches). Even though these cups do a commendable job of holding product, there are at least five problems associated with them as regards the pizzeria industry.

The first problem is that the diameter of the cup precludes it being conveniently packed inside of smaller pizza boxes of 25 centimeters (10 inches) square, or less. This occurs because boxes of that size, when loaded with a properly-sized pizza, lack adequate corner space to properly hold a cup of 5.0 centimeters or larger diameter. This condition is illustrated by FIG. 2 which shows a proportional relationship between a 5-centimeter cup (the smallest of the above-cited food cups) and a 25-centimeter pizza 12 in a 25-centimeter square box 10. Straight lines 14,15 indicate adjoining walls of box 10 converging at a corner 16. A curve 18 indicates the position of the perimeter edge of pizza 12. A circle 30 indicates the position of the top edge perimeter of the cup. As can be seen, circle 30 overlaps, or imposes upon, curve 18, thereby indicating the difficulty of fitting a 5-centimeter cup in the corner space of a 25-centimeter box.

In dealing with this problem, pizza companies have exercised two options. The first option is to adopt an oversized box. The disadvantage of this is increased packaging cost. The second option is to force the sauce cup into the side of the pizza. The disadvantage of this is it can result in a misshapen pizza with reduced eye-appeal. So, there is a need for a food cup that can properly fit in a usable corner space of a 25-centimeter square pizza box.

For purposes herein, a "usable corner space" of a loaded pizza box is defined is a space bounded by two adjoining walls of the box and an imaginary line extending at a 45 degree angle to each of the walls and tangential to the perimeter edge of a properly-positioned round pizza having a diameter equivalent to the width of the bottom panel of the box. A properly-positioned pizza would be one that's positioned with the perimeter edge disposed tangential with each of the two adjoining walls.

To illustrate, FIG. 3 shows a schematic top view of a corner section of a pizza box 10 having walls 14,15 converging at corner 16 and a pizza 12 having a perimeter edge 18. Box 10 has a usable corner space 34, which is that space bounded by (a) an imaginary line 36 which is disposed at a 45 degree angle to walls 14 and 15 and is tangential to edge 18 and (b) sections 38,39 of walls 14,15 which extend line 36 to corner 16. It is noted that usable corner space 34 is an isosceles right triangle with line 36 being the hypotenuse, wall sections 38,39 being the legs, and corner 16 being the vertex of the right angle.

In a 25-centimeter pizza box with a 25-centimeter diameter pizza, hypotenuse 36 is approximately 10.5 centimeters (4.12 inches) and legs 38,39 are approximately 7.5 centimeters (3.0 inches). In a 36-centimeter box, hypotenuse 36 is approximately 14.8 centimeters (5.75 inches) and legs 38,39 are approximately 10.5 centimeters (4.12 inches).

The second problem with the round food cup is that many versions are 4.5 centimeters (1.75 inches) high and, therefore, require that the interior height of the box cavity of a pizza box be at least 4.5 centimeters. Such a requirement prevents a pizza company from saving money by going to a smaller-height box. Of course, it's possible to use a shallower cup, but that would require a cup of even greater diameter which, in turn, would require an even larger oversized box. So, there is a need for a food cup of equivalent volume to the common round cup and that can fit in a corner space of a 25-centimeter box having a height less than 4.5 centimeters.

The third problem with the common round food cup is that it makes inefficient use of usable corner space. Specifically, a circle circumscribed by an isosceles right triangle (i.e., the shape of usable corner space) consumes only 51 percent of that triangle. A rectangle or square placed within the triangle does no better. An oval placed within the triangle consumes only about 60 percent of the usable space. So there is a need for a food cup that can make better use of the triangle-shaped usable corner space of a pizza box.

The fourth problem, which is associated with the third problem, is that only one cup can be packed in a corner of a box. This is a drawback because there's a trend toward packing more types of items in the pizza box, especially with larger-size pizzas that often require more than one food cup per order. So, there is a need for a food cup having a shape that enables two such cups to fit in a single corner space of a larger-size pizza box.

Of course, prior art rectangular cups and oval cups could be used in place of a round cup. However, neither of those shapes offer an advantage because each incurs the same problems as the round cup as far packing in a pizza box is concerned.

The fifth problem with the common round cup is that when packing multiple units in a case for shipping there is a large amount of unused space between the units. This results in minimal number of units per carton which, in turn, results in a large amount of warehouse and truck space per unit.

In addition to the common round cup and containers shown in Photos 1 and 2, there are several triangle-like food containers in the prior art. They include Hoffman U.S. Pat. No. 4,373,636 granted Feb. 15, 1983; Delbanco U.S. Pat. Des. No. 303,766 granted Oct. 3, 1989; France et al. U.S. Pat. No. 5,098,013 granted Mar. 24, 1992; Krupa U.S. Pat. Des. No. 349,050 granted Jul. 26, 1994; Voege U.S. Pat. Des. No. 391,808 granted Mar. 10, 1998; and Ferrin U.S. Pat. Des. No. 392,883 granted Mar. 31, 1998.

However, the above-cited problems have not been solved by any of the prior art. Therefore, it would be highly desirable to provide a food cup of a structure that overcomes the above-described problems and disadvantages. An optimal cup for accomplishing that would (a) have a height less than 3.8 centimeters (1.5 inches), (b) have a structure that would enable the cup to fit within an isosceles right triangle having an hypotenuse length less than 10.5 centimeters, (c) enable use of 70 percent or more of the usable corner space of a pizza box, (d) allow two units to fit in the corner space of a larger-size pizza box, and (e) allow for packing multiple units in a shipping carton with a minimal amount of unused space. My invention provides for such a cup.

OBJECTS AND ADVANTAGES

Accordingly, the first object of my invention is to provide a plastic food cup that can be used for properly packing sauce or other edible product within the corner space of a square pizza box having a wall length of 25 centimeters (10 inches). A second object of my invention is to provide a cup that can fit in the corner space of a 25-centimeter box that has a wall height less than 3.8 centimeters (1.5 inches). A third object of my invention is to provide a cup that utilizes 70 percent or more of usable corner space of a pizza box. A fourth object of my invention is to provide a cup that enables two units thereof to be packed in one corner of a pizza box of larger size (i.e., 36 centimeters, or 14 inches). A fifth object of my invention is to pack multiple units of a food cup in a shipping case with less unused space than is present in a case of common round cups.

The main advantages of my invention are (a) a savings in box cost by being able to pack a 60 milliliter (2.0 fluid ounce) cup in the corner space of a 25-centimeter square pizza box, (b) an improvement in pizza appearance and quality by being able to pack a 60 milliliter cup in the corner space of a 25-centimeter square pizza box without having to force it into the side of the pizza, (c) the opportunity to make better utilization of the corner space of a pizza box, (d) the convenience of being able to pack two food cups in one corner space of a pizza box of larger size, and (e) the efficiency of being able to ship a greater number of cups per case.

Further objects and advantages of the invention will become apparent from consideration of the following detailed description, related drawings, and appended claims.

SUMMARY OF THE INVENTION

In accordance with the invention, a non-radially-symmetrical, pizza-box-fitable food cup is disclosed. Being non-radially-symmetrical, the cup is non-round, non-rectangular, and non-oval. Being pizza-box-fitable, the cup is fitable within a corner space of a 36-centimeter (14-inch) square pizza box loaded with a 36-centimeter diameter pizza. In addition, the structure of the invention satisfies one or more of the following four requirements:

1) Has a top edge perimeter shape having first and second sides wherein, when the cup is properly disposed in the corner space of a pizza box, the second side is facing at least one of the walls that form the corner space and the first side is disposed obliquely to that wall;

2) Has a top edge perimeter shape that (a) is fitable within an isosceles right triangle having an hypotenuse length less than 14.8 centimeters, (b) is bilaterally symmetrical, and (c) comprises a corner-fitting component and a diagonal connecting component extending between opposing ends of the corner-fitting component, with the distance between the opposing ends being longer than a distance between midpoints of the corner-fitting and diagonal connecting components;

3) Has a top edge perimeter shape that has an area that consumes more than 70 percent of an area of an isosceles right triangle circumscribed around the shape, the triangle having an hypotenuse length less than 14.5 centimeters;

4) Has a top edge perimeter shape that allows multiple units of the cup to be arranged within a smaller space within a box than that required for packing a similar number of round cups of similar volume capacity and height.

In its ideal form, or preferred embodiment, the invention is a cup of triangle-like shape having a top edge perimeter shape resembling an isosceles right triangle with rounded corners. As such, the invention provides for optimal utilization of space both within the corner space of a loaded pizza box and within a case packed with multiple units of the cup.

A complete understanding of the invention can be obtained from the detailed description that follows.

LIST OF REFERENCE NUMERALS

Figure 1:
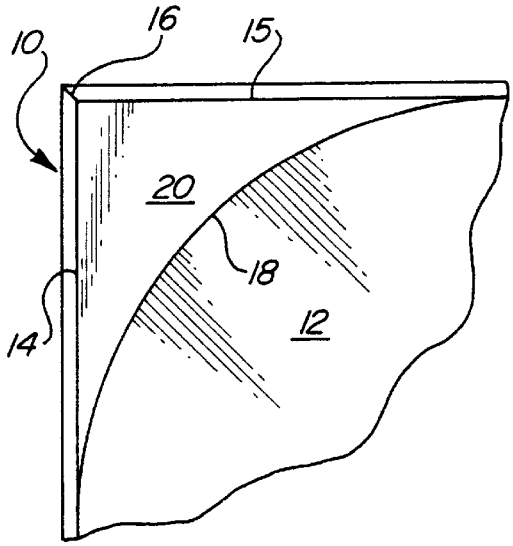
FIG. 1 is a top view of a corner section of the tray portion of a loaded pizza box.
Figure 2:
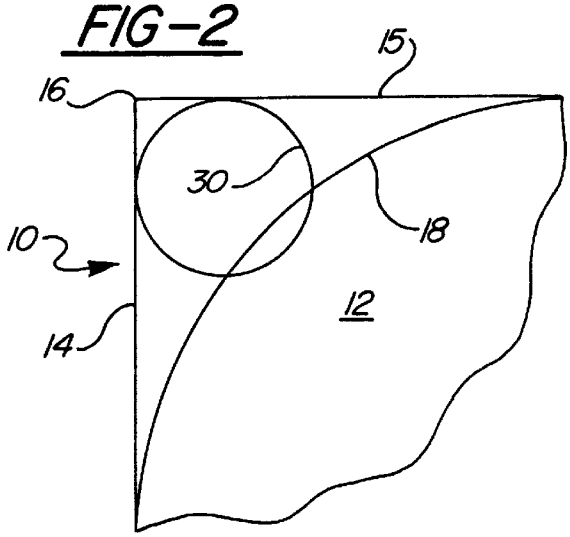
FIG. 2 is a top view sketch showing the proportional amount of overlap of the top edge perimeter of a standard 5-centimeter diameter sauce cup onto the perimeter edge of a 25-centimeter round pizza in a 25-centimeter square box.
Figure 3:
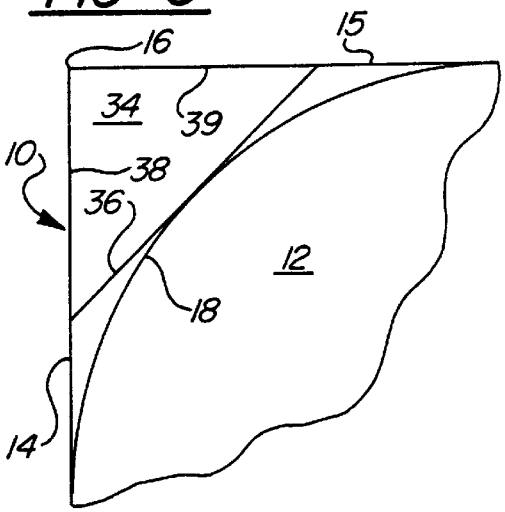
FIG. 3 is a top view sketch showing the usable corner space of a loaded pizza box.
Figure 4:
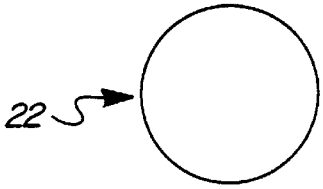
FIG-4 PRIOR ART
FIG. 4 shows the shape of the top edge perimeter of a prior art round cup.
Figure 5:
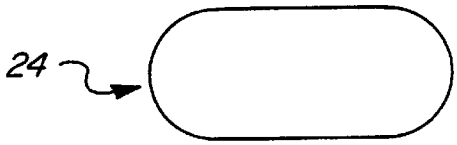
FIG-5 PRIOR ART
FIG. 5 shows the shape of the top edge perimeter of a prior art oval cup.
Figure 6:
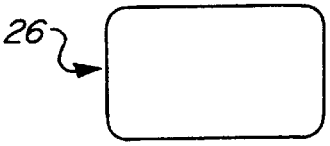
FIG-6 PRIOR ART
FIG. 6 shows the shape of the top edge perimeter of a prior art rectangular cup.
Figure 7:
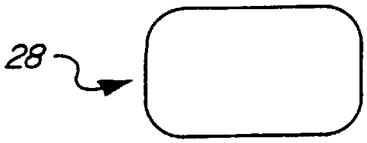
FIG-7 PRIOR ART
FIG. 7 shows the shape of the top edge perimeter of a prior art rounded-rectangular cup.

Between drawings, like reference numerals designate corresponding parts.

10 pizza box
12 pizza
14 box wall
15 box wall
16 corner (vertex of right angle)
18 perimeter edge of pizza
20 corner space
22 round shape of top perimeter edge
24 oval shape of top perimeter edge
26 rectangular shape of top perimeter edge
28 rounded-rectangular shape of top perimeter edge
30 circle (top edge perimeter of cup)
34 usable corner space
36 imaginary line (hypotenuse of right triangle)
38 section of wall (leg of right triangle)
39 section of wall (leg of right triangle)
40 plastic food cup (preferred embodiment)
42 bottom part
44 wall
46 wall
48 wall
52 wall-connecting corner portion
54 wall-connecting corner portion
56 wall-connecting corner portion
58 height of cup
60 top edge perimeter
62 shape of top edge perimeter
63 area of shape of top edge perimeter
64 side of top edge perimeter
66 side of top edge perimeter
68 side of top edge perimeter
72 side-connecting corner portion
74 side-connecting corner portion
76 side-connecting corner portion
80 corner-fitting component
82 diagonal connecting component
84 end of corner-fitting component
85 end of corner-fitting component
86 first dimension
88 second dimension
90 isosceles right triangle
92 first imaginary extension line
94 second imaginary extension line
96 angle
98 removable film-type seal
99 removable and re-attachable lid
100 arrangement of multiple units
101 arrangement of multiple units
102 first unit
104 second unit
112 first unit
114 second unit
120 shape of first alternate embodiment
122 shape of second alternate embodiment
124 shape of third alternate embodiment
126 shape of fourth alternate embodiment
128 shape of fifth alternate embodiment
130 shape of sixth alternate embodiment

DESCRIPTION OF THE PREFERRED EMBODIMENT

Figure 8:
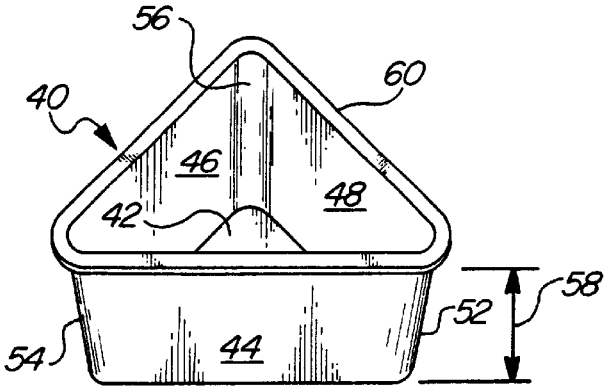
FIG. 8 is a perspective view of the preferred embodiment.

Referring now to the drawings, there is illustrated a preferred embodiment of the invention in FIG. 8. The primary intended use for the embodiment is for packing food product in a pizza box. However, it will be appreciated, as the description proceeds, that my invention may be realized in different embodiments and may be used in other applications.

STRUCTURE OF THE INVENTION

FIG. 8 shows a plastic food cup 40 having a bottom part 42; walls 44, 46, and 48; and wall-connecting corner portions 52, 54, and 56, respectively, which join walls 44,46,48. In the preferred embodiment, walls 44,46,48 are substantially flat and corner portions 52,54,56 are rounded or curved.

Cup 40 has a height 58 which is less than six centimeters (specifically, the height of the preferred embodiment is 3.2 centimeters, or 1.25 inches). It also has a volume capacity greater than 25 milliliters and less than 150 milliliters (specifically, the volume capacity of the preferred embodiment is approximately 60 milliliters, or two ounces).

Cup 40 also has a top edge perimeter 60 which, as the name implies, is the perimeter of the top edge of the cup. Edge 60 has a shape 62, best viewed in FIG. 9. The components of shape 62 are sides 64, 66, and 68 and side-connecting corner portions 72, 74, and 76 which connect to ends of sides 64,66,68. In the preferred embodiment, sides 64,66,68 are straight and corner portions 72,74,76 are rounded or curved. For purposes herein, for a portion of the shape of a top edge perimeter of a cup to qualify as a "side" of that shape, the length of that portion must be greater than 12 percent of the total length of the top edge perimeter.

As compared to prior art food cups, the structure of cup 40 has several unique features which enable its unique functionality and, therefore, should be noted.

First, cup 40 is pizza-box-fitable. As used herein, a "pizza-box-fitable cup" is a cup that's less than six centimeters high and is of a shape that fits within the corner space of a 36-centimeter (14-inch) square pizza box when the box is properly loaded with a 36-centimeter diameter pizza.

Second, cup 40 is non-radially-symmetrical when viewed from the top or, in other words, shape 62 lacks radial symmetry. That means that shape 62 is non-round, non-oval, and non-rectangular.

Third, cup 40 is bilaterally symmetrical when viewed from the top or, in other words, shape 62 has bilateral symmetry. That means that shape 62 can be bisected into two symmetrical parts along one axis or bisecting line only.

Figure 9:
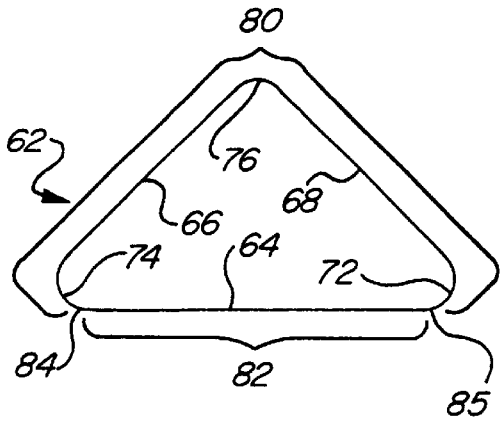
FIG. 9 shows the shape of the top edge perimeter of the preferred embodiment.
Figure 10:
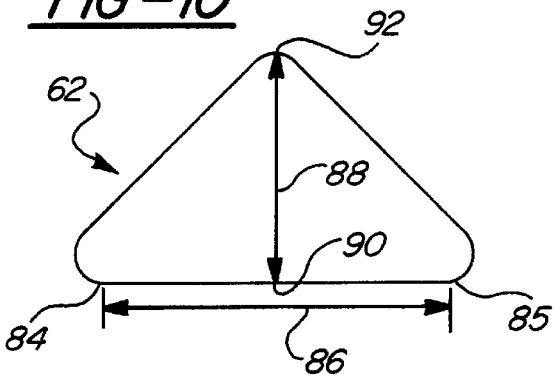
FIG. 10 shows the shape of the top edge perimeter of the preferred embodiment showing dimensions of the corner-fitting component and diagonal connecting components.

Fourth, as shown in FIG. 9, shape 62 can be conceptualized in terms of a corner-fitting component 80 and a diagonal connecting component 82. Corner-fitting component 80 comprises all sides and side-connecting corner portions of shape 62 except for side 64. Further, component 80 has opposing ends 84 and 85, respectively. Diagonal connecting component 82 (a.k.a. side 64) extends between ends 84,85. As shown in FIG. 10, shape 62 has a first dimension 86 that extends between opposing ends 84,85 and a second dimension 88 that extends from a midpoint 90 on diagonal connecting component 82 to a midpoint 92 on corner-fitting component 80. First dimension 86 is longer than second dimension 88. This feature plays a role in enabling cup 40 to hold a greater amount of product within a corner space of a pizza box than can a prior art cup.

Fifth, shape 62 closely resembles an isosceles right triangle and, therefore, is described herein as: (a) a triangle-like shape, (b) a shape resembling a triangle with rounded corners, (c) a shape resembling an isosceles right triangle, and (d) a shape resembling an isosceles right triangle with rounded corners. Side 64 (or diagonal connecting component 82) is considered to be the hypotenuse of the right-triangle-like shape. As a result, side 64 is longer than sides 66,68 and sides 66,68 are of equal length.

Figure 11:
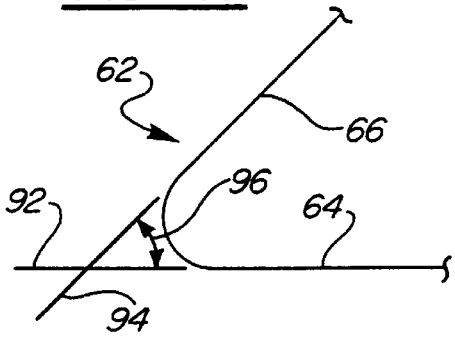
FIG. 11 shows a section of the shape of the top edge perimeter of the preferred embodiment showing the angle of imaginary extension lines.

Sixth, as illustrated in FIG. 11 which shows a section of shape 62, first and second imaginary extension lines 92 and 94, respectively, can project from ends of sides 64 and 66, respectively. When this is done, extension lines 92,94 form an angle 96. Angle 96 is greater than 30 degrees and less than 60 degrees (specifically, in the preferred embodiment angle 96 is 45 degrees). Although not shown, a similar angle exists between side 64 and side 68.

Seventh, shape 62 is fitable within an isosceles right triangle having an hypotenuse length less than 11.5 centimeters.

Figure 12:
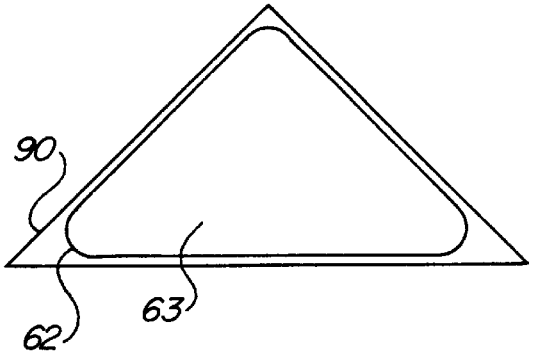
FIG. 12 shows the shape of the top edge perimeter of the preferred embodiment circumscribed by an isosceles right triangle.

Eighth, as illustrated in FIG. 12, shape 62 covers an area 63 which is more than eighty percent of the area of an isosceles right triangle 90 circumscribed around shape 62 (more specifically, area 63 is approximately 97 percent of the area of triangle 90).

Figure 13:
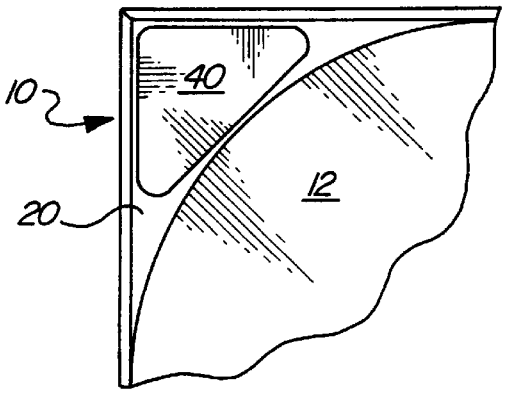
FIG. 13 is a top view diagrammatic sketch of the preferred embodiment in a loaded 25-centimeter (10-inch) pizza box.

Ninth, cup 40 can fit within the corner space of a 25-centimeter (10-inch) loaded pizza box without crowding the pizza. FIG. 13 shows a top view of cup 40 in relation to a 25-centimeter pizza 12 in a 25-centimeter box 10. (Cup 40 is shown with a cover piece on top.)

Figure 14:
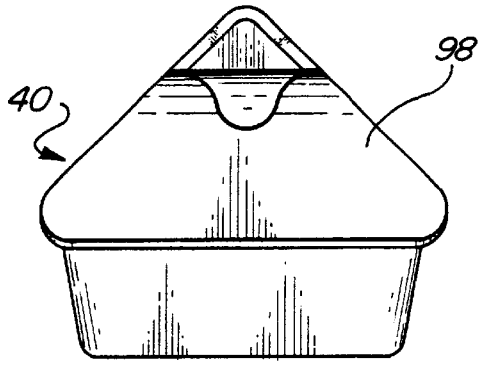
FIG. 14 is a perspective view of the preferred embodiment with a removable film-type seal.
Figure 15:
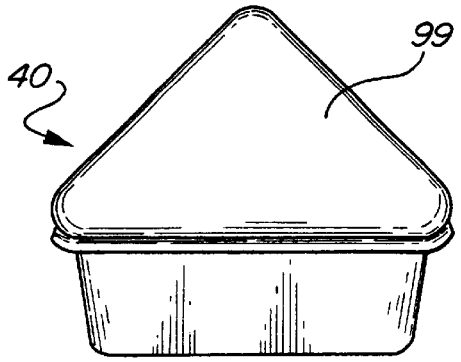
FIG. 15 is a perspective view of the preferred embodiment with a removable and re-attachable lid.

Optionally, cup 40 can equipped with a cover piece and, when that occurs, the cover piece is considered to be part of the cup. One version of cover piece is a removable film-type seal 98 having a triangle-like shape and adhesively secured to the top edge of the cup. This is shown in FIG. 14, in which seal 98 is shown in a semi-removed disposition. Another cover piece is a removable and re-attachable lid 99 that snaps over the top edge of cup 40. Lid 99 has a triangle-like shape, as shown in FIG. 15. It is noted that both cover pieces are non-radially-symmetrical when viewed from the top.

APPLICATION OF THE INVENTION

In addition to the unique structure of cup 40, my invention includes several unique applications.

Figure 16:
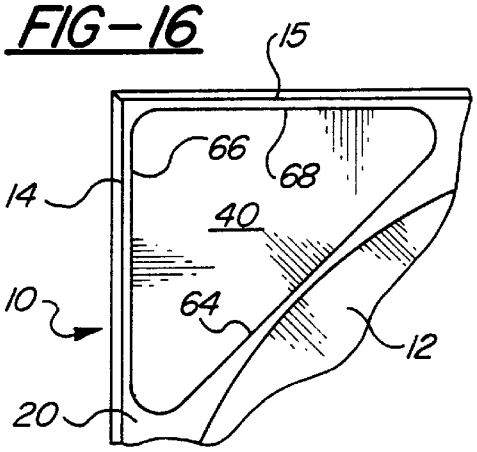
FIG. 16 is a top view diagrammatic sketch of the preferred embodiment in a corner space of a pizza box, showing the relationship of the shape of the top edge perimeter to the walls of the box.

A first application of my invention is how it integrates with the structure of a pizza box. As shown in FIG. 16, when cup 40 is properly positioned in corner space 20 formed by adjoining walls 14,15 of loaded pizza box 10, sides 66,68 of the top edge perimeter of cup 40 face walls 14,15, respectively. Additionally, side 64 is disposed diagonally (or obliquely) to walls 14 and 15. In other words, shape 62 of the top edge perimeter has at least one side facing a box wall and at least one side disposed obliquely to that same wall. This feature plays a role in enabling cup 40 to hold a greater amount of product within a corner space of a pizza box than can a prior art cup.

Figure 17:
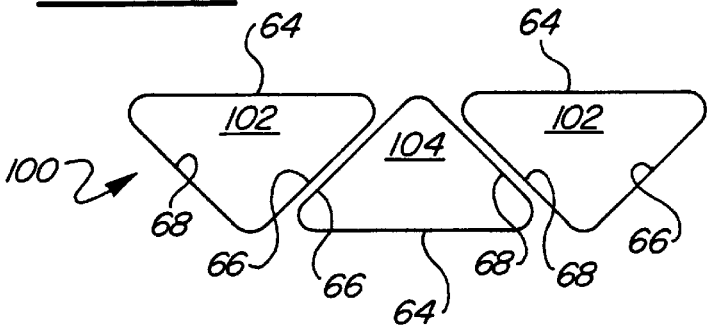
FIG. 17 is a first preferred arrangement of multiple cups of the preferred embodiment depicted by showing the arrangement of the top edge perimeter shapes of three cups.

A second application of my invention involves an arrangement 100 of multiple units of the invention. As illustrated in FIG. 17, in this arrangement a first unit 102 of the preferred embodiment is disposed side-by-side and oriented at 180 degrees to a second unit 104 of the preferred embodiment with a first side (66) of top edge perimeter shape 62 of the first unit adjacent a first side (66) of the second unit. It is noted that this same arrangement can be accomplished by having side 68 of shape 62 be the first side. This feature plays a role in enabling a manufacturer to fit a greater number of units of the preferred embodiment within a particular shipping box than units of the prior art round cup of equivalent volume to that of the preferred embodiment.

Figure 18:
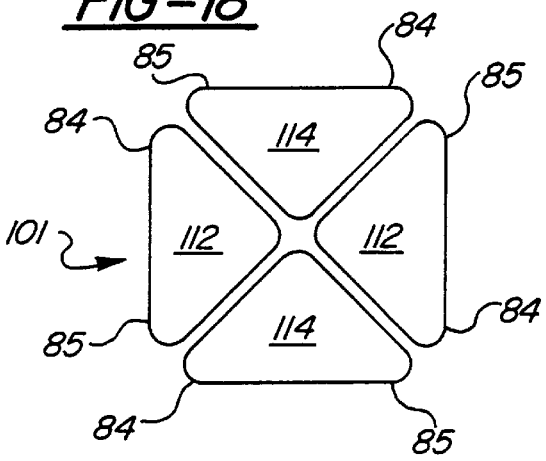
FIG. 18 is second preferred arrangement of multiple cups of the preferred embodiment depicted by showing the arrangement of the top edge perimeter shapes of four cups.
Figure 19:
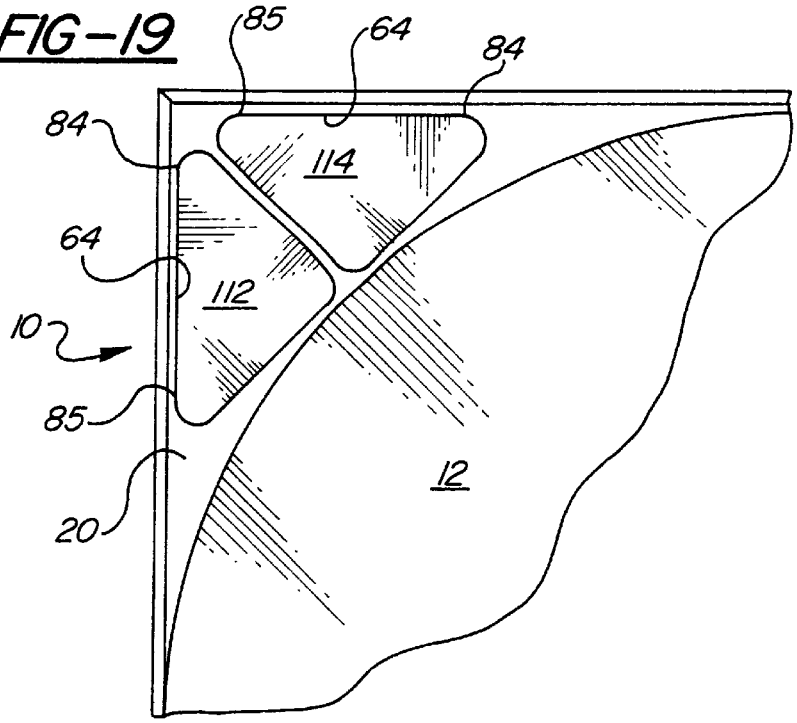
FIG. 19 is a preferred pizza box packing arrangement of two cups of the preferred embodiment within a single corner space of a 36-centimeter loaded pizza box, using the second preferred arrangement.

A third application of my invention involves an arrangement 101 of multiple units of the invention. As illustrated in FIG. 18, in this arrangement a first unit 112 of the preferred embodiment is disposed side-by-side and oriented at 90 degrees to a second unit 114 of the preferred embodiment with a first end (84) of corner-fitting component 80 of one of the units disposed adjacent a second end (85) of the other unit. This feature enables a manufacturer to fit four units into a square pattern and, thereby, fit a greater number of units of the preferred embodiment within a particular shipping box than units of the prior art round cup of equivalent volume to that of the preferred embodiment. In addition, as shown in FIG. 19, this arrangement enables two units (112,114) of the preferred embodiment to be packed within a single corner space of a 36-centimeter (14-inch) loaded pizza box.

DESCRIPTION OF ALTERNATE EMBODIMENTS

Although not recommended as highly as the preferred embodiment, there are a number of alternate embodiments that fall within the scope of the invention and could be used in lieu of the preferred embodiment. A selection is described below. These embodiments, illustrated in FIGS. 20–25, are depicted in terms of the shape of the top edge perimeter of the cup. Each is described in terms of how that shape differs from shape 62 of the preferred embodiment. Although not shown, it should be appreciated that the configuration of walls and wall-connecting corner portions of the cup would generally correspond to the shape of the top edge perimeter.

Figure 20:
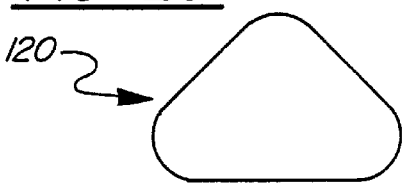
FIG. 20 shows the shape of the top edge perimeter of a first alternate embodiment.

A first alternate embodiment 120 is shown in FIG. 20. Creating this embodiment essentially is accomplished by shortening the length of sides 64,66,68 of the preferred embodiment and turning side-connecting corner portions 72,74,76 into larger curves.

Figure 21:
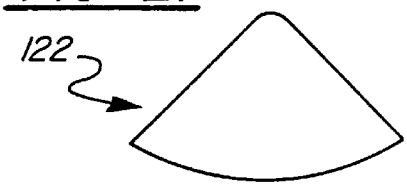
FIG. 21 shows the shape of the top edge perimeter of a second alternate embodiment.

A second alternate embodiment 122 is shown in FIG. 21. Creating this embodiment essentially is accomplished by forming side 64 (or diagonal connecting component 82) of the preferred embodiment into a convex curve. The result is an example of what is referred to as a pie-slice shape.

Figure 22:
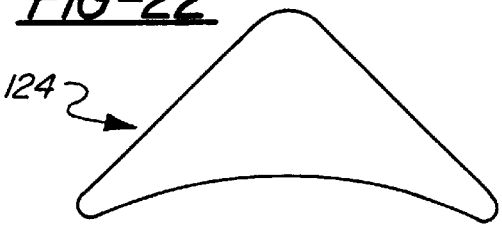
FIG. 22 shows the shape of the top edge perimeter of a third alternate embodiment.

A third alternate embodiment 124 is shown in FIG. 22. Creating this embodiment essentially is accomplished by forming side 64 (or diagonal connecting component 82) of the preferred embodiment into a concave curve. The result is an example of what is referred to as a boomerang-like shape.

Figure 23:
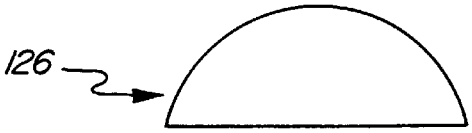
FIG. 23 shows the shape of the top edge perimeter of a fourth alternate embodiment.

A fourth alternate embodiment 126 is shown in FIG. 23. Creating this embodiment essentially is accomplished by forming corner-fitting component 80 of the preferred embodiment into a semi-circle. The result is an example of what is referred to as a half-moon shape.

Figure 24:
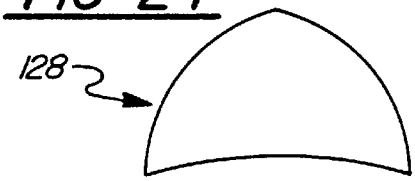
FIG. 24 shows the shape of the top edge perimeter of a fifth alternate embodiment.

A fifth alternate embodiment 128 is shown in FIG. 24. Creating this embodiment essentially is accomplished by forming corner-fitting component 80 of the preferred embodiment into a dome shape and forming diagonal connecting component 82 into a concave curve. The result is an example of what is referred to as a medieval helmet-like shape.

Figure 25:
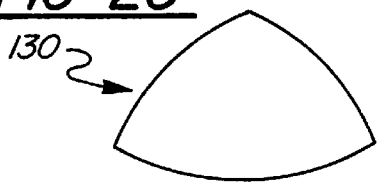
FIG. 25 shows the shape of the top edge perimeter of a sixth alternate embodiment.

A sixth alternate embodiment 130 is shown in FIG. 25. Creating this embodiment essentially is accomplished by forming sides 64,66,68 of the preferred embodiment into convex curves.

DEFINITION OF KEY TERMS

Within this specification and the ensuing claims, certain key terms are used. To insure clear meaning, these terms are now defined as used herein.

A "food cup" is (a) a small cup-like container that holds an edible product or (b) a small cup-like container designed for and commonly used for holding an edible product. Edible product includes such items as sauce, cheese, candy, spices, and pet treat. A "sauce cup" is (a) a food cup that holds a sauce-type product or (b) a food cup designed for and commonly used for holding a sauce-type product. A bag-type or pouch-type container is not considered to be a food A "non-radially-symmetrical" food cup is a food cup having a top edge perimeter that has a shape that is substantially lacking in radial symmetry. For purposes herein, a cup having a substantially rectangular top edge perimeter shape with a short diagonal edge at one corner is regarded as being radially symmetrical and, therefore, would not qualify as being non-radially-symmetrical.

A "bilaterally symmetrical" food cup is a food cup that has a top edge perimeter that has a shape that is bilaterally symmetrical or substantially bilaterally symmetrical.

A "pizza-box-fitable" cup is a cup that's less than six centimeters high and is of a shape that fits within the corner space of a 36-centimeter (14-inch) square pizza box when the box is properly loaded with a 36-centimeter diameter pizza. Herein, it is assumed that the top view shape of the perimeter edge of a pizza is round.

A "triangle-like" shape is a shape that either (a) is a triangle or (b) resembles a triangle. For example, a shape consisting of three substantially straight sides each joined to another of the sides by a small curve would be considered to be a shape that resembles a triangle. Similarly, a "right-triangle-like" shape is a shape that either (a) is a right triangle or (b) resembles a right triangle. Finally, an "isosceles-right-triangle-like shape" is a shape that either (a) is an isosceles right triangle or (b) resembles an isosceles right triangle.

A "pie-slice" shape is a shape roughly resembling the perimeter edge of a slice of round pie viewed from above; an example being shown in FIG. 21.

A "boomerang-like" shape is a shape roughly resembling the perimeter edge of a boomerang viewed from above; an example being shown in FIG. 22.

A "half-moon" shape is a shape roughly resembling the shape of a half moon; an example being shown in FIG. 23.

A "medieval helmet-like" shape is a shape roughly resembling the perimeter edge of a certain type of medieval helmet viewed from the front; an example being shown in FIG. 24.

A "corner space" in a loaded pizza box is a space located between two adjoining walls of the box and the perimeter edge of a properly-sized round pizza positioned with the perimeter edge of the pizza disposed tangential with each of the two adjoining walls. A properly-sized pizza would be a pizza having a diameter equivalent to the width of the bottom panel of the box.

A "usable corner space" in a loaded pizza box is a space bounded by two adjoining walls of the box and an imaginary line extending at a 45 degree angle to each of the walls and tangential to the perimeter edge of a properly-positioned round pizza having a diameter equivalent to the width of the bottom panel of the box. A properly-positioned pizza would be one that's positioned with the perimeter edge disposed tangential with each of the two adjoining walls.

CONCLUSION, RAMIFICATIONS, AND SCOPE

I have disclosed a non-radially-symmetrical, pizza-box-fitable food cup. My invention provides for a cup structure that (a) provides a savings in pizza box cost by being able to pack a 60 milliliter (2.0 fluid ounce) cup in the corner space of a 25-centimeter square pizza box, (b) provides an improvement in pizza appearance and quality by being able to pack a 60 milliliter cup in the corner space of a 25-centimeter square pizza box without having to force it into the side of the pizza, (c) provides the opportunity to make better utilization of the corner space of a pizza box, (d) provides the convenience of being able to pack two food cups in one corner space of a pizza box of larger size, and (e) provides the opportunity to ship a greater number of cups per case.

The illustrated size and shape of the plastic cup and pizza box represent the preferred embodiment; however, other combinations and configurations are possible within the scope of the invention.

For example, in the preferred embodiment, the wall-connecting corner portions and side-connecting corner portions are curved sections. However, instead of being noticeably curved, any of those corner portions could be sharp corners, instead. If such were the case the resulting cup would be regarded as being within the scope of the invention.

Also, the preferred embodiment is a single-cavity cup. However, it's possible to have a divided or multi-cavity cup. If such were the case the resulting cup would be regarded as being within the scope of the invention if t he cup met the requirements of one or more of the claims.

Further, the preferred embodiment is shown with a flat top edge. This is the type of edge that would typically be used for applying the film-type seal. However, a cup made for accepting a re-attachable plastic lid would likely have a rounded or rolled top edge. A cup with such an edge would be regarded as being within the scope of the invention.

Lastly, walls 44,46,48 are substantially flat in the preferred embodiment. However it's possible for those walls to be curved. If such were the case the resulting cup would be regarded as being within the scope of the invention if the cup met the requirements of one or more of the claims.

The foregoing discussion has pertained to a container for packing food product for carrying within a pizza box. However, it should be realized that my invention could be used for other purposes, as well. In conclusion, it is understood that my invention is not to be limited to the disclosed embodiments but, on the contrary, is intended to cover various modification sand equivalent arrangements included within the spirit and scope of the appended claims.

I claim:

1. A non-radially-symmetrical food cup disposed in a corner space of a loaded pizza box, said corner space being bounded by adjoining first and second walls of the box, said non-radially-symmetrical food cup having a top edge perimeter having a predetermined shape comprising first and second sides, wherein said second side faces at least one of said first and second walls and said first side is obliquely disposed to said first and second walls.

2. The non-radially-symmetrical food cup of claim 1 wherein:

said predetermined shape has a predetermined area, said predetermined area being more than seventy percent of an area of an isosceles right triangle circumscribed around said predetermined shape.

3. The non-radially-symmetrical food cup of claim 1 wherein:

said predetermined shape is bilaterally symmetrical.

4. The non-radially-symmetrical food cup of claim 1 wherein:

said predetermined shape further comprises a third side, said second and third sides being of equal length and said first side being longer than each of said second and third sides.

5. The non-radially-symmetrical food cup of claim 1 wherein:

at least one of said first and second sides is curved.

6. The non-radially-symmetrical food cup of claim 1 wherein:

said predetermined shape resembles an isosceles right triangle.

7. The non-radially-symmetrical food cup of claim 6 wherein:

said non-radialiy-symmetrical food cup includes a non-radially-symmetrical cover piece.

8. The non-radiaily-symmetrical food cup of claim 7 wherein:

said non-radially-symmetrical cover piece is a removable and re-attachable lid having a triangle-like shape.

9. The non-radially-symmetrical food cup of claim 7 wherein:

said non-radiaily-symmetrical cover piece is a removable film-type seal having a triangle-like shape and is adhesively secured to a top edge of said non-radially-symmetrical food cup.

10. A pizza-box-fitable sauce cup having a predetermined height less than six centimeters, a maximum volume capacity less than one hundred fifty milliliters, and a top edge perimeter having a predetermined shape fitable within a predetermined isosceles right triangle having an hypotenuse length less than fourteen and one-half centimeters, wherein said predetermined shape is substantially bilaterally symmetrical, comprises a corner-fitting component and a diagonal connecting component extending between opposing ends of said corner-fitting component, and has a first dimension extending between the opposing ends of said corner-fitting component and a second dimension extending from a midpoint on said diagonal connecting component to a midpoint on said corner-fitting component, said first dimension being longer than said second dimension, whereby said pizza-box-fitable sauce cup can hold a greater amount of product within a corner space of a loaded pizza box than can a prior art sauce cup having a height equal to said predetermined height and a top edge perimeter fitable within said predetermined isosceles right triangle.

11. The pizza-box-fitable sauce cup of claim 10 wherein:

said predetermined shape is a triangle-like shape.

12. The pizza-box-fitable sauce cup of claim 10 wherein:

said predetermined shape resembles a triangle with rounded corners.

13. The pizza-box-fitable sauce cup of claim 10 wherein:

said predetermined shape resembles an isosceles right triangle with rounded corners.

14. The pizza-box-fitable sauce cup of claim 10 wherein:

said predetermined shape resembles a pie-slice shape.

15. The pizza-box-fitable sauce cup of claim 10 wherein:

said predetermined shape resembles a boomerang-like shape.

16. The pizza-box-fitable sauce cup of claim 10 wherein:

said predetermined shape resembles a half-moon shape.

17. The pizza-box-fitable sauce cup of claim 10 wherein:

said predetermined shape resembles a medieval helmet-like shape.

18. The pizza-box-fitable sauce cup of claim 10 wherein:

said predetermined shape resembles an isosceles-right-triangle-like shape with each side of the triangle being a slightly convex curve.

19. The pizza-box-fitable sauce cup of claim 10 wherein:

said predetermined shape includes first and second sides each having an imaginary extension line extending from ends thereof, the imaginary extension line of said first side being disposed at an angle to the imaginary extension line of said second side, said angle being greater than thirty degrees and less than sixty degrees.

20. The pizza-box-fitable sauce cup of claim 10 wherein:

said diagonal connecting component incorporates a concave curve.

21. The pizza-box-fitable sauce cup of claim 10 wherein:

said diagonal connecting component incorporates a convex curve.

22. The pizza-box-fitable sauce cup of claim 10 wherein:

said predetermined shape has a predetermined area, said predetermined area being more than eighty percent of an area of an isosceles right triangle circumscribed around said predetermined shape.

23. The pizza-box-fitable sauce cup of claim 10 wherein:

said maximum volume capacity is greater than twenty five milliliters, said predetermined shape is fitable within an isosceles right triangle having an hypotenuse length less than twelve centimeters.

24. The pizza-box-fitable sauce cup of claim 10 wherein:

said pizza-box-fitable sauce cup includes a removable and re-attachable lid having a triangle-like shape.

25. The pizza-box-fitable sauce cup of claim 10 wherein:

said pizza-box-fitable sauce cup includes a removable film-type seal having a triangle-like shape, said seal being adhesively secured to a top edge of the cup.

26. The pizza-box-fitable sauce cup of claim 10 wherein:

said pizza-box-fitable sauce cup is disposed in a corner space of a loaded pizza box.

27. A pizza-box-fitable sauce cup having a predetermined height less than six centimeters, a maximum volume capacity greater than twenty five milliliters and less than one hundred fifty milliliters, and a top edge perimeter having a predetermined shape having a predetermined area, wherein said predetermined area is more than seventy percent of an area of a predetermined isosceles right triangle circumscribed around said predetermined shape, said predetermined isosceles right triangle having an hypotenuse length less than fourteen and one-half centimeters, whereby said pizza-box-fitable sauce cup can hold a greater amount of product within a corner space of a loaded pizza box than can a prior art sauce cup having a height equal to said predetermined height and a top edge perimeter fitable within said predetermined isosceles right triangle.

28. The pizza-box-fitable sauce cup of claim 27 wherein:

said predetermined shape resembles an isosceles right triangle.

29. The pizza-box-fitable sauce cup of claim 27 wherein:

said pizza-box-fitable sauce cup includes a removable and re-attachable lid having a triangle-like shape.

30. The pizza-box-fitable sauce cup of claim 27 wherein:

said pizza-box-fitable sauce cup includes a removable film-type seal having a triangle-like shape, said seal being adhesively secured to a top edge of the cup.

31. The pizza-box-fitable sauce cup of claim 27 wherein:

said pizza-box-fitable sauce cup is disposed in a corner space of a loaded pizza box.

32. Substantially identical first and second pizza-box-fitable food cups, each of the cups having a top edge perimeter having a predetermined non-radially-symmetrical shape comprising a first side, wherein said first and second pizza-box-fitable food cups are disposed side-by-side and oriented at one hundred eighty degrees from each other and the first side of said first cup is adjacent the first side of said second cup, whereby optimal space utilization is achieved compared to space utilization achieved from side-by-side first and second round cups each having a volume and height equal to a volume and height of said first and second pizza-box-fitable food cups.

33. The first and second pizza-box-fitable food cups of claim 32, wherein in each of the cups:

said predetermined non-radially-symmetrical shape resembles an isosceles right triangle.

34. Substantially identical first and second pizza-box-fitable food cups, each of the cups having a top edge perimeter having a predetermined non-radially-symmetrical shape comprising a corner-fitting component and a diagonal connecting component extending between opposing first and second ends of said corner-fitting component, wherein said first and second pizza-box-fitable food cups are disposed side-by-side and oriented at ninety degrees from each other and the first end of said first cup is disposed adjacent the second end of said second cup, whereby optimal space utilization is achieved compared to space utilization achieved from side-by-side first and second round cups each having a volume and height equal to a volume and height of said first and second pizza-box-fitable food cups.

35. The first and second pizza-box-fitable food cups of claim 34, wherein in each of the cups:

said predetermined non-radially-symmetrical shape resembles an isosceles right triangle.

* * * * *